US005304900A

United States Patent [19]

Hayazaki et al.

[11] Patent Number: 5,304,900

[45] Date of Patent: Apr. 19, 1994

[54] SPINNING FRAME

[75] Inventors: Isao Hayazaki, Ogaki; Makoto Ohmori, Tsushima; Shigeki Sekiya, Kuwana, all of Japan

[73] Assignee: Howa Machinery, Ltd., Aichi, Japan

[21] Appl. No.: 916,621

[22] Filed: Jul. 22, 1992

[30] Foreign Application Priority Data

Jul. 31, 1991 [JP] Japan ..... 3-215815

[51] Int. Cl.[5] ..... H02P 7/74; H02J 9/00

[52] U.S. Cl. ..... 318/34; 318/106; 318/107; 318/109; 307/68; 307/66

[58] Field of Search ..... 318/6, 16, 106, 78, 318/107, 109, 34, 799-823; 307/64, 66, 48, 68; 19/240; 57/92, 81, 100, 266, 274, 276, 265, 264; 242/18.1, 45

[56] References Cited

U.S. PATENT DOCUMENTS

| | | | |
|---|---|---|---|
| 4,736,580 | 4/1988 | Wolf | 57/100 |
| 4,749,920 | 6/1988 | Jaeger et al. | 318/112 |
| 4,788,818 | 12/1988 | Meissner | 57/264 |
| 4,879,475 | 11/1989 | Rüge et al. . | |
| 4,987,734 | 1/1991 | Meyer | 57/100 |
| 5,113,123 | 5/1992 | Noser et al. | 318/106 |

FOREIGN PATENT DOCUMENTS

| | | |
|---|---|---|
| 0318144 | 5/1989 | European Pat. Off. . |
| 0406176 | 1/1991 | European Pat. Off. . |
| 3347113 | 7/1985 | Fed. Rep. of Germany . |
| 3633627 | 4/1988 | Fed. Rep. of Germany . |
| 60-155729 | 8/1985 | Japan . |
| 63-264923 | 11/1988 | Japan . |
| 2-221424 | 9/1990 | Japan . |
| 3-40819 | 2/1991 | Japan . |
| WO9007595 | 7/1990 | PCT Int'l Appl. . |
| WO9015474 | 12/1990 | PCT Int'l Appl. . |

*Primary Examiner*—Paul Ip

*Attorney, Agent, or Firm*—Stevens, Davis, Miller & Mosher

[57] ABSTRACT

A flyer frame has a first AC motor for obtaining a general rotational movement of various parts of the frame and a second AC motor for obtaining only a variable component of the rotational movement of the bobbin. An inverter is provided for operating the first and second AC motor. A controller is divided into a general section for operating the frame powered by AC power source, and a winding section for obtaining a winding control of the frame. The winding control section is operated by a DC current, which is usually supplied by an outside AC source. A DC output of the inverter is connected to the winding section via a diode or relay, which usually disconnects the DC line to the winding section and which is closed upon the occurrence of the power failure, for supplying a regenerating current from the inverter to the winding section. A desired winding control is thus maintained upon the occurrence of the power failure, until the stoppage of the frame, to prevent rovings at respective spinning positions from being broken.

12 Claims, 3 Drawing Sheets

SPINNING FRAME

BACKGROUND OF THE INVENTION

1. Field of the Invention

The present invention relates to a spinning frame, such as a flyer frame or fine spinning frame, provided with two AC (alternate current) motors for operating different parts of the spinning machine, and more particularly, a device for controlling the different AC motors upon a power failure, without a breakage of a roving or thread at respective spinning portions of the spinning frame.

2. Description of the Related Art

Known in a prior art is a flyer frame having a first AC motor imparting a rotational movement to drafting parts and flyers, and a second AC motor independent from the first AC motor and used for imparting a variable rotational movement to bobbin wheels. Inverters are provided for the first and second AC motors, respectively, for obtaining a desired rotational speed control of these AC motors. This type of flyer frame can eliminate a conventional cone drum type speed control mechanism fed by a single electric motor for controlling the varied speed of the bobbin. See Japanese Unexamined Patent Publication No. 63-264923 and Japanese Unexamined Patent Publication No. 3-40819. In the first patent ('923), a controller executs a calculation of a bobbin rotational speed from a detected spinning speed and the diameter of a bobbin including a wound roving on the bobbin, and the second AC motor is controlled by an inverter so that the calculated bobbin rotational speed is obtained. In the second patent ('819), a rotating angle of a front roller of a drafting part and the diameter of a bobbin including the wound roving are detected, and a controller operates the AC motor so that a desired rotating angle of the bobbin is obtained. Furthermore, the inverter controls an accelerated or decelerated rotation of the AC motors, upon a start or stoppage when a full bobbin state is obtained.

In such a type of flyer frame, wherein two or more independent motors are provided for rotating different parts of the flyer frame, upon the occurrence of a power failure, rotating parts connected to the respective AC motors continue to rotate for a while due to the inertial moments of the respective rotating parts, which have usually different values. As a result, before a completely stoppage after the commencement of the occurrence of the power failure, the rotating parts connected to one of the AC motors, i.e., the drafting parts and flyers, having a larger inertia value take a longer time to stop than the other rotating parts, connected to the other AC motor, i.e., the bobbin wheels, having a smaller inertia value. As a result, a relationship of rotational speeds between the parts connected to the first AC motor and the part connected to the second AC motor after the power failure becomes different from that desired during normal operation, which causes the tensions of rovings to be outside a desired range, and thus a desired winding of the rovings is not obtained, and accordingly, sometimes almost of all the rovings are simultaneously broken at the respective spinning position of the flyer frame.

To obviate such a problem arising upon the occurrence of the power failure, Japanese Unexamined Patent Publication No. 60-155729 and Japanese Unexamined Patent Publication No. 2-221424 discloses a concept whereby, upon an occurrence of a power failure, from the rotating parts having the larger inertia connected to the first AC motor, via the inverter, a regeneration electric power is taken out and supplied to the second AC motor connected, via the corresponding inverted, to the rotating parts having the smaller inertia. A back-up battery is provided by supplying the control circuit for both of the inverters, so that the desired rotation of the first and second AC motors is obtained until the motors are completely stopped, even though a power failure has occurred.

The prior art system wherein the controller to the inverters of the first and second AC motors, respectively, is operated by the back-up battery suffers from a drawback in that frequent maintenance is required for a supplementation or exchange of a battery liquid, and the battery itself must be periodically replaced. Furthermore, an additional device is required for a charging thereof, which increases the overall cost.

SUMMARY OF THE INVENTION

An object of the present invention is to provide a spinning frame capable of overcoming the above-mentioned difficulty in the prior art.

Another object of the present invention is to provide a spinning frame capable of eliminating the necessity for a battery upon a power failure while maintaining a desired winding control up to the stoppage of the frame.

According to the present invention, a spinning frame is provided, comprising:

a drafting unit for drafting a fiber assembly;

a bobbin for receiving the drafted fiber assembly;

means for applying a rotation movement to the bobbin;

means for forming layers of the fiber assembly wound onto the bobbin;

a first AC motor for generating a rotational movement;

a second AC motor for generating a rotational movement used for obtaining a variable speed of the rotating movement of the bobbin and allowing a desired winding condition of the layers of the fiber assembly wound of the bobbin to be obtained;

said first AC motor being used for obtaining the rotating movement of parts and not for obtaining said variable speed of the rotating movement of the bobbin;

a controller for controlling the operation of the spinning frame, the controller being divided into a winding control section operated by a DC alone for controlling the winding operation, including the variable speed control of the second AC motor and the layer forming means, and a general control section for obtaining various control operations other than said winding operation;

an inverter arranged between an outside AC power source and the first AC motor for obtaining the rotation of the first AC motor by the outside AC power source;

drive means, arranged between the inverter and the second AC motor, for obtaining the rotation of the second AC motor by the DC current induced by the inverter;

an AC to DC converter arranged between the outside AC power source and the winding control section of the controller for usually supplying power to the winding control section by the outside AC power source and;

means for connecting, upon a power failure, the inverter to said winding control section of the controller, which allows a regenerating current in said inverter to be supplied to the winding control section to thereby allow it to continue to execute a winding operation until a stoppage of the spinning frame.

During a usual condition, the controller including the general section and the winding section are supplied by the outside power source. Namely, the rotational movement of the second AC motor is controlled in relation to the rotational movement of the first AC motor. Furthermore, a reciprocal movement of the bobbin, and stop motion are also controlled. Upon a power failure, a regenerating electric current is taken out from the first AC motor via the inverter, and is supplied to the winding control section, whereby the desired winding control operation can be continued up to the stoppage of the frame.

DESCRIPTION OF THE PREFERRED EMBODIMENTS

Figure 1:
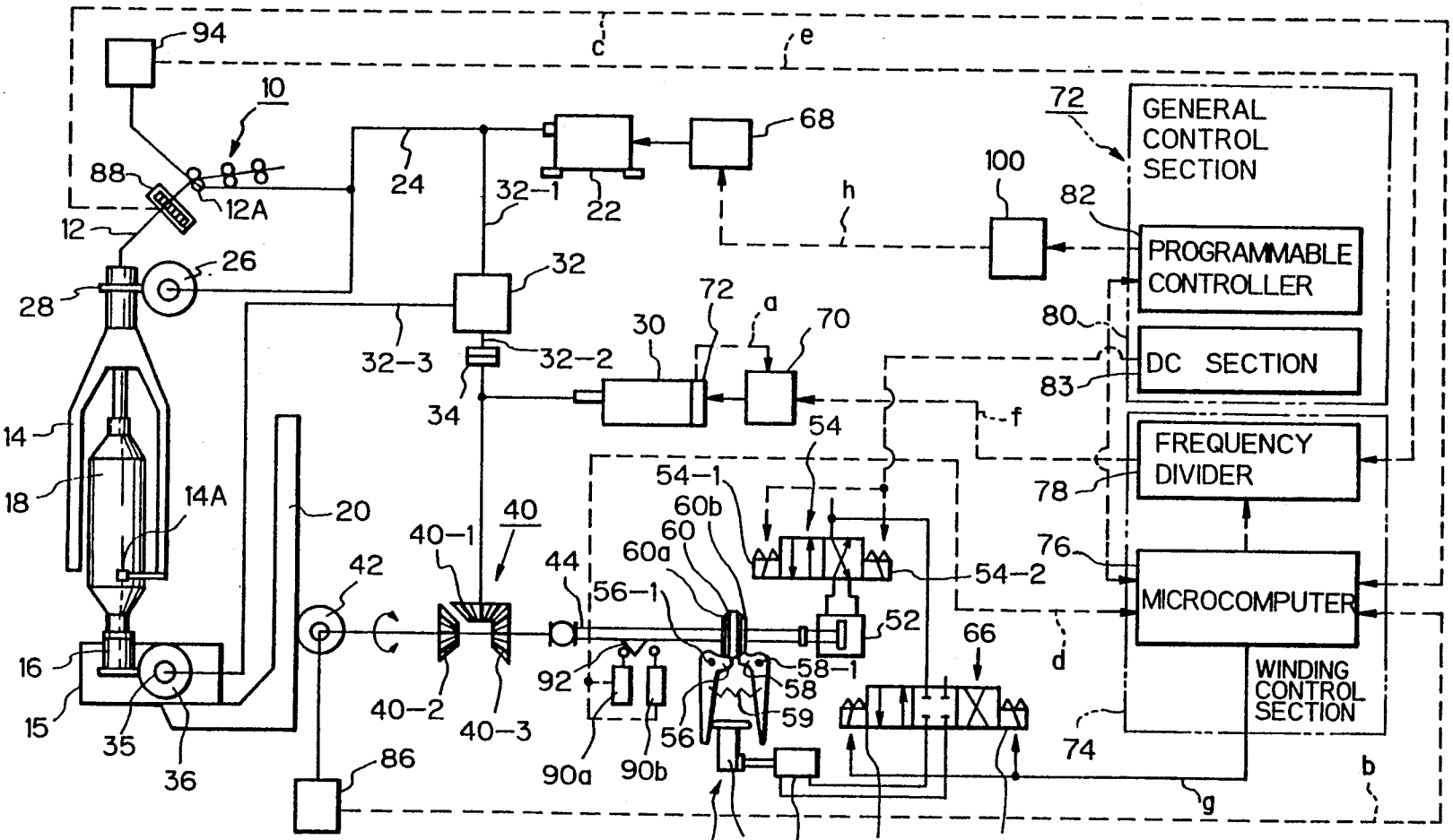
FIG. 1 is a schematic entire view of the flyer frame according to the present invention, illustrating how the flyer frame is driven, and how various control signals are transmitted to respective parts thereof.

In FIG. 1, reference numeral 10 denotes a drafting unit constructed by a plurality of spaced pairs of rollers, and a roving 12 is subjected to a drafting by the drafting unit 10. Reference numeral 14 is a flyer, 15 a bobbin rail, 16 a bobbin wheel on which a bobbin 18 is mounted, and 20 a lifter rack.

A main motor 22 as an AC motor is connected, via a transmission line 24 constructed by belt transmission mechanisms (not shown) and a gear transmission mechanism (not shown), to a front roller 12A of the drafting unit 10 for imparting a rotational movement to the front 12A, and to a drive pinion 26, which engages with a driven gear 28 on the flyer 14 for imparting a rotational movement to the flyer 14. The flyer 14 is provided, at its bottom end, with a presser 14A engaging with the roving wound on the bobbin 18.

A reference numeral 30 is a variable speed second motor as an AC servo motor. A differential mechanism 32 has a first inlet shaft 32-1, to which a rotation from the main motor 22 is applied, a second inlet 32-2, which is connected to the second motor 30 via an electromagnetic clutch 34, an outlet shaft 32-3 connected to a bobbin shaft 35. At the differential mechanism 32, the rotational movement applied to the first inlet shaft 32-1 from the main motor 22 and the rotational movement applied to the second shaft 32-2 from the second motor 30 are combined, and the combined rotational movement is obtained at the outlet shaft 32-3. The outlet shaft 32-3 is connected to the bobbin shaft 35, on which a drive pinion 36 is mounted, so that the pinion 36 engages the bobbin wheel 16 for imparting the combined rotational movement to the bobbin 18.

The second motor (AC servo motor) 30 is also connected, via a reverse mechanism 40, to a pinion 42, which engages with a rack portion of the lifter rack 20 and allows the lifter rack 20 to obtain a vertical reciprocal movement in accordance with the direction of the rotation of the pinion 42. The reverse mechanism 40 has an inlet bevel gear 40-1 connected to the second AC motor 30, and a pair of opposite outlet bevel gears 40-2 and 40-3, located on a reversing rod 44, which is axially movable between a first position where the inlet gear 40-1 engages with the first reversing gear 40-2 for causing the pinion 42 to rotate in one direction to thereby cause the lifter rack 20 and the bobbin rail 15 connected thereto to be moved in one vertical direction, for moving the roving wound on the bobbin 18 to be moved in one vertical direction, and a second position where the inlet gear 40-1 engages with the second reversing gear 40-3 to thereby cause the pinion 42 to rotate in the other direction, causing the lifter rack 20 and the bobbin rail 15 to be moved in the other vertical direction, for moving the roving wound on the bobbin 18 to be moved in the other vertical direction.

A reference numeral 50 generally denotes a bobbin shaping device for controlling the horizontally reciprocal movement of the reversing rod 44, for controlling the switching of the movement of the direction of the vertical movement of the bobbin rail 15 so that a desired shape of the robbin 18 is obtained. Namely, the bobbin shaping device 50 controls the direction of movement of the reversing rod 44, for switching the engagement of the inlet bevel gear 40-1 between the first and second reversing gears 40-2 and 40-3 to thus switch the movement of the bobbin rail 15. The bobbin shaping device 50 includes a first air cylinder 52 for obtaining a horizontally reciprocal movement of the reversing rod 44, a two position, four port valve 54 for operating the first cylinder 52, a pair of horizontally spaced apart stopper levels 56 and 58, between which a engagement member 60 fixed to the reversing rod 44 is arranged, a second cylinder 62 connected to a stopper releaser 64, and a three position four port valve 66 for operating the second air cylinder 62. The first air cylinder 52 has a piston and a piston rod connected to the reversing rod 44. The stopper levers 56 and 58 are pivotally rotatable about respective axis for rotation 56-1 and 58-1, respectively, and a spring 59 is arranged between the stopper levers 56 and 58 to cause them to be moved toward each other. The stopper levers 56 and 58 form, respectively, a crank shape constructed by a short arm and a long arm. The engagement member 60 on the reversing rod 44 has axially opposite stepped portions 60*a* and 60*b*, which respectively face the stopper levers 56 and 58, respectively, at their respective short arms. It should be noted that the first and second air cylinders 52 and 62 are connected to a suitable air pressure source. The first switching valve 54 has a first solenoid 54-1 and a second solenoid 54-2, and a first position wherein the air source is connected to one side of the piston of the cylinder 52 for moving the piston to one direction and a second position where the air source is connected to the other side of the piston of the cylinder 52 for moving the piston to the other direction. The second switching valve 66 has a first solenoid 66-1 and a second solenoid 66-2, and a first position wherein the air source is connected to one side of the piston of the cylinder 62 for moving the piston in one direction, a second (neutral) position where the air source is blocked, and a third position where the air source is connected to the other side of the piston of the cylinder 62 for moving the piston in the other direction.

In a condition where the reversing rod 44 is situated so that the drive bevel gear 40-1 engages the reversing bevel gear 40-3 as shown in FIG. 1, the right-hand stepped portion 60*b* of the engagement member 60 on the reversing rod 44 engages the right hand stopper 58, which allows the reversing rod 44 to be maintained in a position where the drive gear 40-1 engages the reversing gear 40-3. In this condition, the rotation of the second motor 30 is transmitted to the pinion 42 for rotating it in one direction, to cause the rack 20 and the bobbin rail 15 to move in one vertical direction. In order to switch the direction of the vertical movement of the bobbin rail 16, the first switching valve 54 is situated so that an air pressure is applied to the first air cylinder 52 such that the reversing rod 44 is urged to be moved in the right-hand direction in FIG. 1. The movement of the reversing rod 44 in the right hand direction is initially prohibited, because the right hand stepped portion of the engagement member 60 engages the right hand stopper 58, which allows the pressure in the air cylinder 52 to be increased. Then a signal is applied to the second switching valve 66, to allow the pressure to be introduced into the second cylinder 62 so that the stopper releaser 64 moves to the right, which causes the stopper releaser 64 to be brought into contact with the long arm of the second stopper 58, which causes the stopper 58 to be rotated in a counterclockwise direction about the pivot pin 58-1 so that the shorter arm of the stopper 58 is disengaged from the engagement member 60 against the force of the spring 59. Thus, an instant movement of the reversing rod 44 in the right hand direction is obtained which causes the bevel gear 40-1 to engage with a left hand reversing gear 40-2 while the stopper lever 56 is engaged at the short arm thereof with the left-hand stepped portion 60*a* of the engaging member. The second switching valve 66 is then de-energized, which causes it to be moved to the neutral position. In this condition, the rotation of the second motor 30 is transmitted to the pinion 42, for rotating it in the other direction, and thus cause the rack 20 and the bobbin rail 15 to move in the other vertical direction.

In order to move the bobbin rail 16 in the left hand direction, the first switching valve 54 is situated so that an air pressure is applied to the first air cylinder 52 so that the reversing rod 44 is urged to be moved to the left in FIG. 1. The movement of the reversing rod 44 in the left hand direction is initially prohibited because the left hand stepped portion 60*a* of the engagement member 60 engages, the left hand stopper 56, which allows the pressure to be increased in the air cylinder 52. Then, a signal is applied to the second switching valve 66, to allow the pressure to be introduced into the second cylinder 62 and the stopper release 64 to move in the left hand direction, which causes the stopper release 64 to come into contact with the long arm of the first stopper 56, and causes the stopper 56 to be rotated in a clockwise direction about the pivot pin 56-1, so that the shorter arm of the stopper 56 is disengaged from the engagement member 60 against the force of the spring 59. Thus, an instant movement of the reversing rod 44 in the left hand direction is obtained, which causes the drive bevel gear 40-1 to be engaged with a right hand reversing gear 40-3. The second switching valve 66 is then de-energized, and thus is moved to the neutral position.

Figure 2:
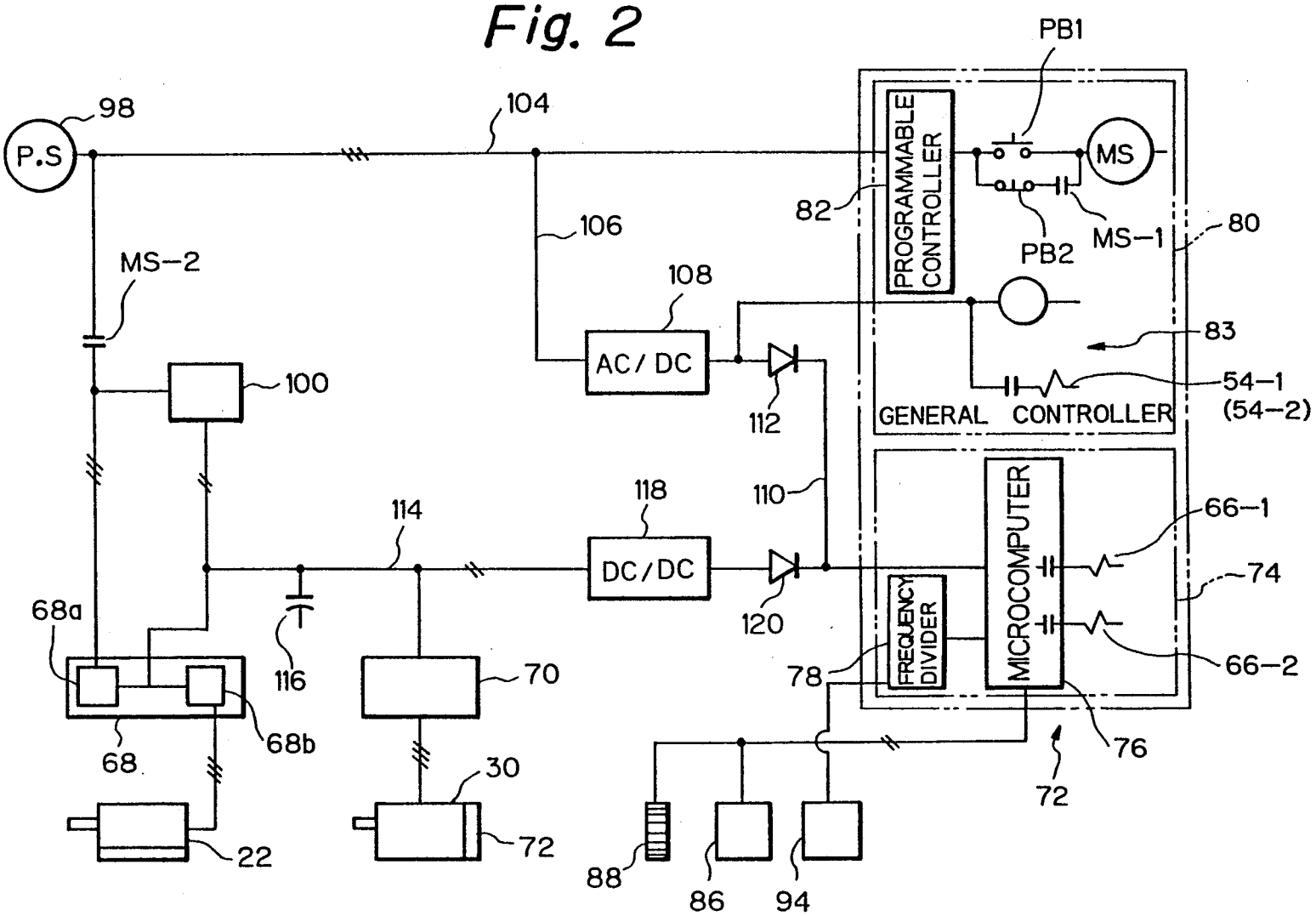
FIG. 2 is a schematic view of the electric system of the flyer frame according to the embodiment in FIG. 1; and, FIG. 3 partially shows a second embodiment of the present invention.

A reference numeral 68 is an inverter for receiving a DC current and changing it to an AC signal that is introduced into the main (AC) motor 22. The inverter 68 is constructed by a converter unit (DC portion) 68*a* connected to an AC power supply and an inverter unit (AC portion) 68*b* connected to the main motor 22 as shown in FIG. 2. In order to operate the second AC servo motor 30, a servo amplifier 70 is provided and is connected to a pulse encoder 72, which detects an angle of the rotation of the AC servo motor 30. The servo amplifier 70, as fully described later, is powered by DC current for operating the second AC servo motor 30. A feed back circuit is provided between the pulse encoder 72 and the AC servo motor 30 for providing a feed back signal a from the encoder 72 to the servo amplifier 70.

A main control circuit 72 is constructed by a winding control section 74 for obtaining a winding control of the flyer frame, which includes microcomputer 76 having a central processing unit (CPU), a read only memory (ROM), a random access memory (RAM), and a inlet and outlet port, and a frequency divider 78 connected to the micro computer 76, and by a second control section 80 for obtaining various controls of the flyer frame other than the winding control, which includes a programmable controller 82, and a DC control section 83. The microcomputer 76 of the winding control section 74 is connected to a not shown keyboard for in putting data for a winding control of a roving, such as data for calculating a current diameter of the bobbin, including an initial diameter of the bobbin at the beginning of the winding of the roving, a thickness of one layer of the roving, and a value of a factor for calculating a tension from a degree of slack in the detected roving, data related to the shape of the wound bobbin, and data related to spinning conditions, and these data are stored in the memory.

Various sensor and actuator a connected to the input and output port of the microcomputer 76. An encoder 86 connected to a pinion 42 is connected to the port, and a signal corresponding an absolute vertical position b of the bobbin rail 15 is input thereto. A sensor 88 is arranged between the drafting unit 10 and the flyer 14 for detecting a degree of slack in the roving 12 corresponding to a tension of the roving 12 between the drafting unit 10 and the flyer 14. This sensor 88 is disclosed in Japanese Unexamined Patent Publication No. 60-34628, and is constructed by a plurality of vertically spaced apart sets of a light emitter and receiver. The sensor 88 is connected to the inlet and outlet port for inputting a signal c related to the tension of the roving. A pair of limit switches 90*a* and 90*b* are stationarily arranged astride a dog 92 fixed to the reversing rod 44. The first limit switch 90*a* is made ON when the reversing rod 44 at its most left-hand position, where the pinion 40 is engaged with the reversing gear 40-3 for obtaining a movement of the bobbin rail 15 in one vertical direction, and the second limit switch 90*b* is made ON when the reversing rod 44 is at its most right-hand position, where the pinion 40 is engaged with the reversing gear 40-2 for obtaining a movement of the bobbin rail 15 in the other vertical direction. These limit switches 90*a* and 90*b* are connected to the inlet and outlet port for inputting a signal d indicating a direction of the vertical movement of the bobbin rail 10. The microcomputer 76 calculates, based on the input data, a winding diameter of the bobbin 18, and calculates, with respect to the calculated winding diameter, a frequency dividing ratio which corresponds to a ratio of the rotating angle of the bobbin 18 to the rotating angle of the front roller 12A, which ratio is set to the frequency divider 78 each time the direction of the movement of the bobbin rail 15 is switched. Namely, the frequency divider 78 is connected to a pulse encoder 94 for issuing a rotating pulse signal e of the front roller 12A of the drafting unit 10. The frequency divider 78 issues a pulse signal f, the frequency of which corresponds to that of the rotating pulse e from the pulse encoder 94 as multiplied by the ratio. This signal f is input to the servo amplifier 70, which operates the servomotor 30 to thus impart a rotational movement to the bobbin wheel 16 via the differential mechanism 32 and the pinion 36. As a result, the servo-amplifier 70 operates the servo-motor 30 for controlling the rotational speed of the bobbin 18 so that, with respect to the current winding diameter of the bobbin 18, a calculated ratio of the rotational speed of the bobbin 18 to the rotational speed of the front roller 12A is obtained. Namely, the rotational speed bobbin 18, which is faster than that of the flyer 18, decreases as the winding diameter of the bobbin 18 increases. As a result, a desired winding of the roving onto the bobbin 18 is obtained from the beginning to the end of the winding process.

In addition to the control of the rotational speed of the bobbin 18, the microcomputer 76 also controls the switching of the vertical movement of the bobbin rail 15 for obtaining a desired conical shape of the bobbin as wound. Namely, based on stored data related the desired wound shape of the bobbin, a point for switching the movement of the bobbin rail 15 is calculated. When the position of the bobbin rail 15 detected by the encoder 86 matches the calculated switching point, a signal g is issued to energize the desired solenoid 66-1 or 66-2 of the second switching valve 66, to thus switch the vertical movement of the bobbin rail 15 to a desired direction.

In FIG. 2, the winding control section 74 together with the related units, i.e., the encoder 86 for detecting the vertical position of the bobbin rail 15 and the encoder 94 for detecting the rotational speed of the front roller related encoders 86 and 94, and the sensor for detecting the tension of the roving 12, are supplied by a direct current electric source.

Contrary to this, the programmable controller 82 in the general control section 80 is supplied by an AC current source. Namely, as shown in FIG. 2, the programmable controller 82 is connected to an AC current source 98 on one hand, and is connected to a relay MS for controlling a power supply to the flyer frame via a normally opened, start switch PB1. Connected in parallel to the start switch PB1 is a series-connection of a normally closed emergency stop switch PB2 and a contact MS-1 of the main relay MS, whereby "self-retaining" circuit is created, which allows the flyer frame to be continuously supplied by the electric source if the main switch PB1 is pushed once, so long as the emergency stop switch PB2 is not pushed. Furthermore, the programmable controller 82 is connected to a device for detecting, a breakage at any spinning position, for stopping the supply of the roving at the spinning position. The program controller 82 can also control a doffing operation when a full bobbin state is obtained for changing the full bobbins to empty bobbins. In FIG. 1, the programmable controller 82 is connected to the inverter 68 via a power failure detection device 100 for issuing a signal h to energize the inverter 68 and control the speed. Furthermore, the DC control section 80 is used for operating, for example, the solenoids 54-1 and 54-2 of the first switching valve 54.

A power supply operation between the main motor 22, the inverter 68, the AC servo motor 30, the AC servo amplifier 70, and the main control system 72 will be explained with reference to FIG. 2. The AC power supply 98 is connected, via a second contact MS-2 of the main relay MS, to the converter section 68*a* of the inverter device 68 and to the power failure detection device 100. The AC power supply 98 is also directly connected to the programmable controller 82 via a line 104. Branched from the AC supply line 104 to the programmable controller 82 of the general control section 80 supplied by the AC current is a line 106 on which an AC to DC converter 108 is located, which transforms the input AC current to output DC current to be supplied to the DC current section 83 in the general control section 80, such as the solenoids 54-1 and 54-2, which are operated by the DC current. It should be noted that the level of the output voltage of the AC-DC converter 108 is substantially the same as that of the winding control section 74, for example, 24 volt DC. The outlet of the AC-DC converter 108 is connected, via line 110, to the winding control section 74, and a diode 112 is arranged on the line 110 so that the anode of the diode 112 is connected to the AC-DC converter 109 and the cathode is connected to the winding control section 74.

As explained above, the inverter device 68 is constructed by the converter unit 68*a* and the inverter unit 68, which are connected in series. The inverter section 68*b* is connected to the main motor 22. The converter unit 68*a* is connected, at its DC outlet, to the AC servo amplifier 70 via a common direct current bus 114. A capacitor 116 is connected to the bus 114, for supplementing a shortage in the electric power at the end of the regenerating operation during the occurrence of an electric failure, and for supplying the power failure detecting sensor 100 until the regeneration operation is commenced after the occurrence of the electric failure. The DC current bus 114 is also connected to a DC-DC converter 118, which supplies, for a while, the winding control section 74 operated by DC current generated by the regenerating circuit, where a power failure has occurred. The DC-DC converter 118 has a wide range of a permissible input voltage value, i.e., a range between 110 volt to 330 volt DC, so that a stable DC output voltage can be obtained even when there is a decrease in the regenerated voltage. A diode 120 is arranged between the DC-DC converter 118 and the microcomputer 76 in such a manner that the anode of the diode 120 is connected to the output of the DC-DC converter 118, and the cathode of the diode 120 is connected to the microcomputer 76, and further, to the cathode of the diode 112. It should be noted that the output voltage of the DC-DC converter 118 has a voltage level such as 23 volt DC, which is high enough to allow the winding control section 74 to be operated under a stable condition, but is lower than the output voltage from the AC-DC converter 108. A voltage level at the output of the AC-DC converter 108 larger than the output voltage level of the DC-DC converter 118 causes the diode 120 to be put in a cut off or reversed bias condition, and thus, under the non-power failure condition, the winding control section 74 is powered by the AC-DC converter 108 powered by AC power source 98. Contrary to this, upon a power failure, the output voltage at the AC-DC converter 108 is lost, and the DC-DC converter 118 has a certain voltage at the output due to the regenerating operation, caused by the rotation of the motor 22 induced by the inertia of the flyer flame. As a result, a cut-off condition of the diode 120 is cancelled, which allows the winding control section 74 to be powered by the regenerating current until the rotating movement of the motor 22 under the effect of inertia is stopped.

The power failure detection device 100 operates under the AC current from the AC power supply during a nonpower failure condition, and operates under the DC current as regenerated from the inverter device 7 during the power failure condition. Namely, under the power failure condition, the power failure detection device 100 monitors the regenerating current, and issues a speed control signal to the inverter device 68 so that the main motor 22 is stopped after a time passed from the occurrence of the power failure is shorter than a time for stopping the main motor 22 when it is freely run after the power failure, so that a regenerating electric power from the inverter device 68 is prevented from producing an excessive power which would be otherwise introduced into the AC servo amplifier 70 or winding control section 74.

Now, the operation of the flyer frame will be explained. During a usual nonpower failure condition, the general controller 80 for obtaining various control operations for the flyer frame other than winding control is operated by the AC electric current directly from the source 98 and DC electric current from the AC-DC converter 108 connected to the AC power source. In addition, the winding control unit 7 is also supplied by the AC-DC converter 108 connected to the AC power source 98. Namely, during the nonpower failure condition, the general controller 80 as well as winding control unit 74 are operated by the AC electric current from the power source 98, although the AC-DC converter 108 connected to the AC power source 98 is provided for obtaining a DC electric current for operating the DC current section 83 of the general control unit 80 and the winding control section 74. When the starting button PB1 is pushed for starting the flyer frame, the main relay MS is energized, which causes is first contact MS-1 to be made ON, and thus the main relay MS is maintained in the energized condition even if the push button PB1 is released. Namely, a self-maintaining operation is obtained. The energizing of the main relay MS also causes its second contact MS-2 to be made ON, which allows the inverter device 68 is supplied by the AC power source 98. The programmable control device 82 in FIG. 1 then issues, via the power failure detecting device 100, signals for operating the inverter 68 and signals h for designating the speed of the motor 22, so that the main motor 22 is rotated until the speed designated is obtained. In this case, in order to attain the speed control as desired, the converter unit **68*a* converts the AC current from the AC power source 89 to a DC current, and the converter unit 68*b* converts the DC current into an AC current, which is supplied to the first or main AC motor 22. The DC current obtained at the outlet of the converter unit 68*a* is also supplied, via the DC bus 114, to the AC servo amplifier 70 powered by the DC current. Namely, from the frequency divider 74 of the winding control section 74, a signal for commencing the servo operation is introduced into the servo amplifier 70. Simultaneously, from the encoder 94 connected to the front roller 12A of the drafting part 10, a pulse signal e having a pulse width corresponding to the rotating angle of the front roller 12A is input to the frequency divider 74, and a pulse signal f is issued to the AC servo amplifier 70. The pulse signal f has a pulse width which corresponds to a preset frequency dividing ratio corresponding to the winding diameter of the bobbin 18, multiplied by the pulse width of the pulse signal e from the encoder 94. The AC servo amplifier 70 issues, into the AC servo motor 30, an AC signal in accordance with the pulse signal f from the frequency divider 74. It should be noted that the pulse signal f from the frequency divider 78 corresponds to a decrease in the bobbin rotational speed, which is executed each time the direction of the movement of the bobbin rail 15 is switched. Such a decrease in the bobbin rotational speed makes it possible to maintain a predetermined speed difference between the flyer 14 and the bobbin 18, irrespective of an increase in the winding diameter of the bobbin caused by a switching of the movement of the bobbin rail 15. The constant speed difference between the flyer 14 and the bobbin allows the roving 12 issued from the drafting unit 10 to be wound on the bobbin 18**. Thus the bobbin rotation angle is always controlled to a desired value which matches the current winding diameter and the angular speed of the front roller l2A.

The timing of the switching of the movement bobbin 15 is calculated from the data related to the bobbin shape stored in the memory. At each timing of the switching timing as obtained, a signal is issued from the winding control section 74 to the desired one of the solenoid 66-1 or 66-2 of the directional switching valve 66, to allow the stopper release 64 to release the corresponding stopper 56 or 58, whereby the reversing rod 44 is moved to a desired direction for switching an engagement of the drive pinion 40-1 between the reversing gears 40-2 and 40-3, which allows the movement of the bobbin rail 15 to be switched. Upon each switching of the direction of the movement of the bobbin rail 15, the frequency divider 74 is set to the desired dividing ratio that matches the diameter of the newly wound layer of the roving on the bobbin 18.

When a stop switch (not shown) is pressed during the normal winding process, the programmable controller 80 continues to issue a signal directed to the inverter 68, but the speed instruction is diminished so that the main motor 22 is gradually stopped, which causes the pulse signal e from the encoder 94 to be gradually coarsened, so that the output pulse f to the AC servo amplifier 70 to the second motor 30 is also gradually coarsened, which allows the roving 12 to be properly wound on the bobbin until the motor 30 is completely stopped.

It should be noted that the DC current generated in the DC bus line 114 during the normal running condition does not adversely affect the operation of the winding control unit 74 connected to the DC bus line 114. Namely, the DC current of a voltage such as 23 volts appears at the outlet of the DC-DC converter 118 connected to the DC bus line 114 and is applied to the anode of the diode 120, but the voltage level at the outlet of the AC-DC converter 108 connected to the cathode of the diode 120, during the normal running condition, is higher than the voltage level at the anode of the diode 120. As a result, the diode 120 is brought to the reverse bias condition, which prevents the DC current at the DC bus line 114 from being disconnected from the winding control unit 74 during the normal operating condition.

When a power failure occurs during the winding process, both the programmable controller 82 supplied by the AC current and the control circuit 83 supplied by the DC current are de-energized, which causes the main relay MS to be de-energized and the contact MS-2 to be made OFF, to cause the self-holding circuit to be opened and prevent the main relay MS from being made ON even if the power failure state is cancelled. At the same time, the de-energization of the main relay MS causes the contact MS-2 to open, but the electric charge held in the capacitor 116 can maintain its operation so that a control signal from the detector 100 is introduced into the inverter 68 to cause the main motor 22 to be stopped faster than it would be if it is freely running. Thus, a large inertia of the flyers 14 and/or draft rollers 10, which allows the main motor 22 to continue to rotate, causes it to regenerate an electric power, which is transformed at the inverter 68 into a DC current to be introduced, via the diode 120, into the winding control section 74 via the DC-DC converter 118. The regenerated DC current allows the winding operation to continue under the power failure detecting circuit 100, AC servo amplifier 70, the winding control section 74, the tension detecting unit 88, and the encoders 86 and 94. As a result, a desired winding control operation upon the power failure is maintained in the same way as that in the usual operation, up to the complete stoppage of the flyer frame. A power failure may, of course, arise at any phase in a winding process of the bobbin from an empty state to a full bobbin state. Suppose that the power failure occurs just before a switching of the movement of the bobbin rail 15, even in such a case the winding control section 74 supplied by the regenerating current issues a signal directed to the corresponding solenoid 66-1 or 66-2, which causes the switching valve 66 to be moved in a desired direction, to cause the piston of the cylinder 62 to be moved to a desired direction and allow the bobbin rail 15 to be switched to the desired direction. This operation at the power failure is also obtained when the emergency stoppage switch PB2 is pushed.

As a modification of the embodiment in FIG. 1, in place of the AC servo motor 72, a usual type AC motor is employed, and the AC servo amplifier is changed to a second inverter device, which supplies a speed control signal to the usual type AC motor.

Figure 3:
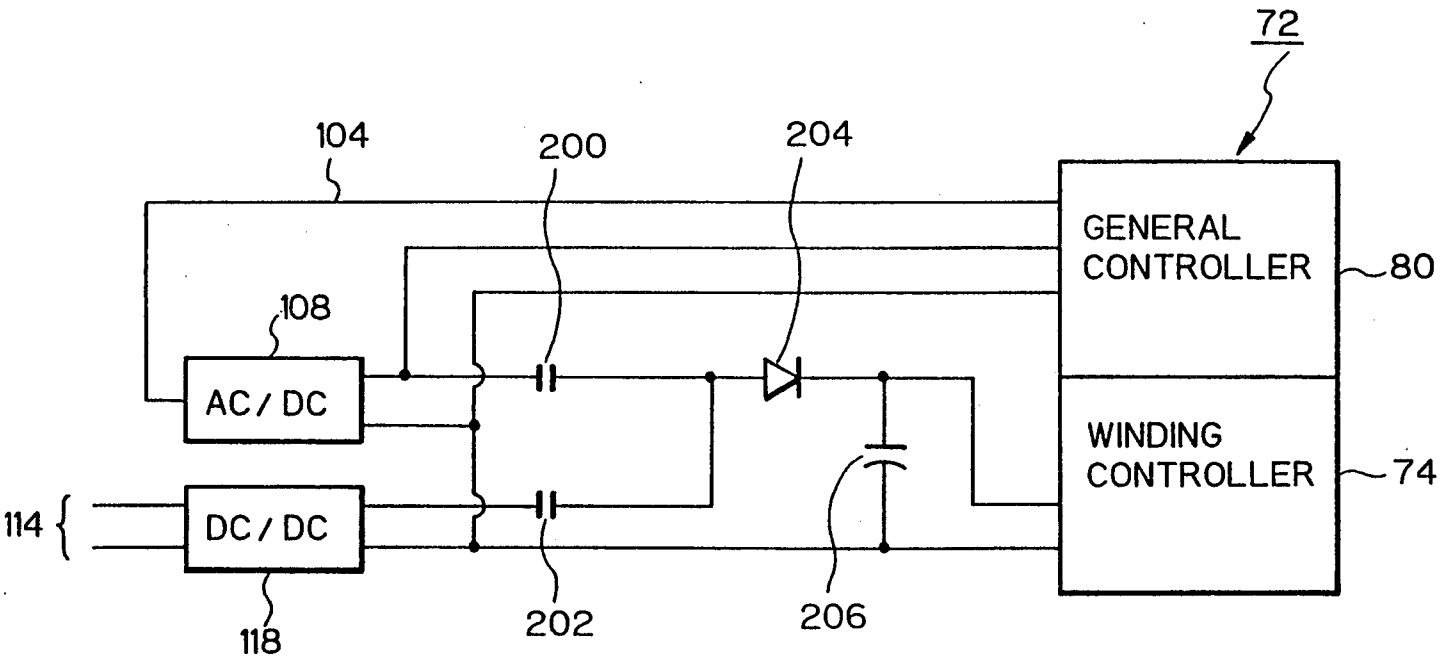

FIG. 3 shows a modification of the connection of the AC-DC converter 108 and DC-DC converter 118 to the winding control section 74. A first relay 200 is made ON when a normal operation of the general controller 80 is obtained, and a second relay 202 is normally made OFF, but is made ON when a power failure has occurred. The first relay 200 is connected, at its one end, to the AC-DC converter 108 and is connected, at the other end, to an anode of a diode 204. The second relay 202 is connected, at its one end, to the DC-DC converter 118 and is connected, at the other end, to the anode of the diode 204. A cathode of the diode 204 is connected to a large volume capacitor 206 at one end and to the winding control section 74. The other end of the capacitor 206 is grounded.

In an operation of the modification in FIG. 3, during a normal operation, the first relay 200 is energized and the second relay 202 is de-energized, so that the winding control section 74 is supplied by the AC-DC converter 108 supplied by the AC power source. Upon an electric failure, the second relay 202 is energized, which causes the winding control section 74 to be supplied with the regenerating DC current from the inverter 68 (FIG. 2).

The above embodiment is directed to the flyer flame having the first AC motor obtaining a general rotating movement, and the second AC motor 72 for obtaining a rotational movement of parts controlling the winding motion. However, the flyer frame may have three AC motors, the first being for rotating the flyers and draft sections, the second for rotating the bobbins, and the third for obtaining a vertical reciprocal movement. An inverter device would be provided for each of the AC motors, and a regenerating current obtained at the first AC motor upon the electric failure will be used for operating the winding control sections and the respective inverter devices for the second and third AC motors.

While the embodiments of the present invention are described with reference to the attached drawings, many modification and changes can be made by those skilled in this art without departing from the scope and spirit of the present invention.

We claim:

1. A spinning frame comprising:

a drafting unit for drafting a fiber assembly;

a bobbin for receiving the drafted fiber assembly;

means for applying a rotational movement to the bobbin;

means for obtaining layers of a fiber assembly wound on the bobbin;

first AC motor means for generating a rotational movement;

second AC motor means for generating a rotational movement used for obtaining a variable speed of the rotating movement of the bobbin, which allows a desired winding condition of the layers of the fiber assembly wound of the bobbin to be obtained;

said first AC motor means being used for obtaining the rotating movement of other parts and not for obtaining said variable speed of the rotating movement to the bobbin;

a controller for controlling the operation of the spinning frame, the controller being divided into a winding control section operated by a DC alone for controlling the winding operation, including the variable speed control of the second AC motor means and said layer forming means, and a general control section for obtaining various control operations other than said winding operation;

inverter means arranged between an outside AC power source and the first AC motor means for obtaining the rotation of the first AC motor means by the outside Ac power source;

means, arranged between the inverter and the second AC motor means, for obtaining the rotation of the second AC motor means by the DC current induced by the inverter means;

an AC to DC converter arranged between the outside AC power source and the winding control section of the controller, for usually supplying the winding control section by the outside AC power source, and;

means, upon a power failure, for connecting the inverter to said winding control section of the controller, which allows a regenerating current in said inverter to be supplied to the winding control section to thus continue to execute a winding operation until a stoppage of the spinning frame.

2. A spinning frame according to claim 1, wherein said connecting means comprise a means connected to the AC power supply for detecting a power failure, and means for controlling the inverter after the occurrence of the power failure so that the winding control section of the controller is supplied by the regenerating current from the inverter.

3. A spinning frame according to claim 2, wherein said inverter control means comprise means for supplying the detection means upon the occurrence of the power failure, and means for usually disconnecting the inverter to the winding section of the controller and for allowing, upon the occurrence of the power failure, the connection of the inverter to the winding section for introducing the regenerating current from the inverter to the winding section.

4. A spinning frame according to claim 3, wherein detecting means provide, upon the occurrence of the power failure, a signal directed to the inverter so that the main motor can be stopped faster than the main motor can be stopped if it is rotated freely.

5. A spinning frame according to claim 3, wherein said means for supplying the detection means upon the occurrence of the power failure comprise an electric capacitor.

6. A spinning frame according to claim 3, wherein said disconnecting means comprise a diode having an anode connected to the inverter and a cathode connected to winding control section at a point where the AC-DC converter is connected to the winding control section.

7. A spinning frame according to claim 3, wherein said disconnecting means comprise a relay arranged between the inverter and the winding control section, the relay being usually opened, but being closed upon the occurrence of a power failure.

8. A spinning frame according to claim 1, wherein said second motor is an AC servo motor, and wherein said means for connecting the inverter with the second AC motor comprise an AC servo amplifier controlled by the winding control section.

9. A spinning frame according to claim 6, further comprising a DC-DC converter arranged between the inverter and the anode of the diode.

10. A flyer frame comprising:

a drafting unit for drafting a roving;

a bobbin rail on which a bobbin for receiving the roving as drafted from the drafting unit, the bobbin rail having thereon a bobbin wheel for applying a rotational movement to the bobbin;

means for reciprocating the bobbin rail while the bobbin is rotated so that layers of the roving wound on the bobbin are obtained;

a first AC motor means for generating a rotational movement;

a second AC motor means for generating a rotational movement used for obtaining a variable speed of the rotating movement of the bobbin, which allows a desired winding condition of the layers of the roving wound of the bobbin to be obtained;

said first AC motor means being used for obtaining the rotating movement of other parts but not for obtaining said variable speed of the rotating movement to the bobbin;

a controller for controlling the operation of the flyer frame, the controller being divided into a winding control section operated by the DC motor alone for controlling the winding operation, including the variable speed control of the second AC motor means and the reciprocating movement of the bobbin rail, and a general control section for obtaining various control operations other than said winding operation;

inverter means arranged between an outside AC power source and the first AC motor means for obtaining the rotation of the first AC motor means by the outside AC power source;

a means for connecting the inverter with the second AC motor means for obtaining the rotation of the second AC motor by DC current induced by the inverter;

an AC to DC converter arranged between the outside AC power source and the winding control section of the controller for usually supplying the winding control section by the outside AC power source, and;

means, upon a power failure, for connecting the inverter to said winding control section of the controller, which allows a regenerating current in said inverter to be supplied to the winding control section to allow it to continue to execute a winding operation until a stoppage of the flyer frame.

11. A flyer frame according to claim 10, wherein said first AC motor means comprise a single AC motor for obtaining all of the rotating movement other than that for obtaining variable speed rotating movement of the bobbin.

12. A flyer frame according to claim 10, wherein said first AC motor means comprise a first AC motor obtaining rotating movement of the drafting device and flyer, and a third AC motor for obtaining a rotating movement for obtaining the reciprocal movement of the bobbin rail, wherein the second motor means comprises a single, second AC motor for obtaining rotational variable movement of the bobbin, said inverter means comprise inverters connected to the first, second and third motors, respectively, and wherein a regenerating current from said first AC motor upon the power failture is used for operating said winding section.

* * * * *